United States Patent [19]

Wüthrich

[11] 4,294,553

[45] Oct. 13, 1981

[54] RIBBON FEED MECHANISM

[75] Inventor: Werner Wüthrich, Gümligen, Switzerland

[73] Assignee: Autelca AG, Güligen, Switzerland

[21] Appl. No.: 141,476

[22] Filed: Apr. 18, 1980

[30] Foreign Application Priority Data

Apr. 20, 1979 [CH] Switzerland ..... 3717/79

[51] Int. Cl.[3] ..... B41J 33/44; B41J 33/46

[52] U.S. Cl. ..... 400/219.1; 242/190; 400/221; 400/225

[58] Field of Search ..... 242/200–204, 242/186–189; 360/71, 74.1, 74.2, 74.3; 400/218, 219.1, 221, 223, 225

[56] References Cited

U.S. PATENT DOCUMENTS 3,677,176 7/1972 Foley et al. ..... 400/219.1
3,902,585 9/1975 Mogtader ..... 400/219.1

FOREIGN PATENT DOCUMENTS 2337191 2/1975 Fed. Rep. of Germany ..... 400/223
1206391 8/1959 France ..... 242/190

*Primary Examiner*—Leonard D. Christian
*Attorney, Agent, or Firm*—Brady, O'Boyle & Gates

[57] ABSTRACT

An inked-ribbon feed mechanism comprises an electric drive motor (5), reversible for reversing the ribbon feed direction, and a reversing switch (32) for the motor (5). A roller (31) operating the reversing switch (32) travels along a cam (28, 29) formed on one arm (21) of a lever (19, 20, 21). A further arm (19) of this lever carries one (14) of two ribbon guides (13, 14) coupled with each other. The motor (5) drives a worm (6). A worm wheel (7) is firmly connected to a pinion (8) and is displaceable together with the latter along the worm (6) in two positions. In one position (8) the pinion meshes with a toothed rim (3) provided on one of the two ribbon spool carriers (1). In the other position (8') the pinion meshes with a toothed rim (4) formed on the other ribbon spool carrier (2).

9 Claims, 3 Drawing Figures

RIBBON FEED MECHANISM

BACKGROUND OF THE INVENTION

The invention relates to a ribbon feed mechanism with an electric drive motor reversible for reversing the ribbon feed direction.

It is known in typewriters to transport the inked ribbon, after each depression of a, or the, type key, by one step by taking off the ribbon stepwise from a ribbon spool and winding it on the other spool. Once the ribon has run its length, the ribbon feed direction is reversed so that the ribbon is now taken off from the spool on which it was previously wound, and is wound up on the spool from which it was previously taken off. The mechanism effecting this ribbon feed and the reversal of the feeding direction is expensive from a constructional viewpoint, is sensitive to dirt, and cannot be utilized, in particular, with matrix printers, for the movements of the pins cannot yield any power for ribbon feed (to rotate a ribbon spool). Ribbon feed can be executed more simply by an electrical drive motor, especially in electrically driven printers, e.g. matrix printers, in particular since a reversal of the drive direction can be reliably attained by simple electrical switching means which, in case of an electronically controlled printer, e.g. matrix printer, require only a minor supplementation of the entire control circuit.

In a commercial matrix printer comprising a ribbon feed mechanism driven by a reversible electric motor, the latter is reversed by an electronic control circuit. The electronic control circuit responds to the current rise occurring once the inked ribbon, the ends of which are attached to respectively one ribbon spool, can no longer be wound onto the driven ribbon spool because it has been completely pulled off the other ribbon spool so that the motor can no longer execute a revolution, i.e. it is blocked, thus absorbing a current which is stronger than the operating current. In case of bistable circuits customary for such control operations, it is uncertain, and left up to coincidence, which direction of revolution the motor has assumed at the time the matrix printer is turned off and is then turned on again. Thus, no assurance was afforded that the ribbon in each case was wound completely from one spool to the other and only thereafter was taken off and again completely wound onto the first-mentioned spool. The result was wear and tear nonuniformly distributed along the length of the ribbon and thus a shorter lifetime of the ribbon; for a partially used-up ribbon can no longer be utilized even if it still contains quite well usable areas. Therefore, one had either to tolerate the shorter useful life of the ribbon, or one had to take care that the printer remained turned on at all times, thus having to contend with consumption of power even during nonuse.

The invention is based on the object of providing a ribbon feed mechanism of the type mentioned hereinabove wherein the ribbon, after the printer equipped with the mechanism has been turned off and then on again, is always advanced reliably in the same direction in which it was last advanced before the printer was turned off, so that the ribbon feed direction in all cases is reversed only if the ribbon has been unwound down to one of its ends.

SUMMARY OF THE INVENTION

A ribbon feed mechanism has first and second ribbon spool carriers rotatably connected on axes adjacent each other so as to reversably automatically feed ribbon from one to the other. A reversible electric drive motor, that is reversible for reversing the ribbon feed direction between the first and second ribbon spool carriers, is connected to drive a respective one of the first or second ribbon spool carriers through a worm drive assembly, that includes a combination worm wheel and drive pinion rotatably mounted on one end of a pivot arm, with the pinion moveable into driving engagement with the respective ribbon spool carrier means by movement of the pivot arm by the worm wheel traveling across the worm gear of the motor. Two mutually coupled ribbon guide members in the form of pivot arms coupled together by a push rod are respectively pivotally connected for movement about the respective axes of the first and second ribbon spool carriers. A catch on the ribbon adjacent on of its ends and being wider then the ribbon guide gap on the pivot arm, engages one of the ribbon guides and pivotally moves the two mutually coupled pivot arms from a first position coordinated with the first ribbon feed direction into a second position coordinated with the opposite ribbon feed direction. A second catch on the ribbon adjacent its other end engages the other of the ribbon guides on the other pivot arm and pivotally moves the two mutually coupled arms from the second position into the first position. A cam assembly is conneced for movement with one of the mutually coupled pivot arms and moves a cam follower (or vise versa) that is connected to actuate a switch, for reversing the motor, between its two switch positions. The reversing switch is actuated by the cam follower to the first switch position when the pivot arms are in the first position, to rotate the motor in the direction to transport the ribbon in the first ribbon feed direction; and the reversing switch is actuated by the cam follower to the second switch position when the mutually coupled pivot arms are in the second position, to rotate the motor in the direction to transport the ribbon in the opposite ribbon feed direction.

BRIEF DESCRIPTION OF THE DRAWING

The drawing shows one embodiment of the present invention with its parts essential to the invention, shown in a simplified from, in which.

DESCRIPTION OF THE PREFERRED EMBODIMENT

Figure 1:
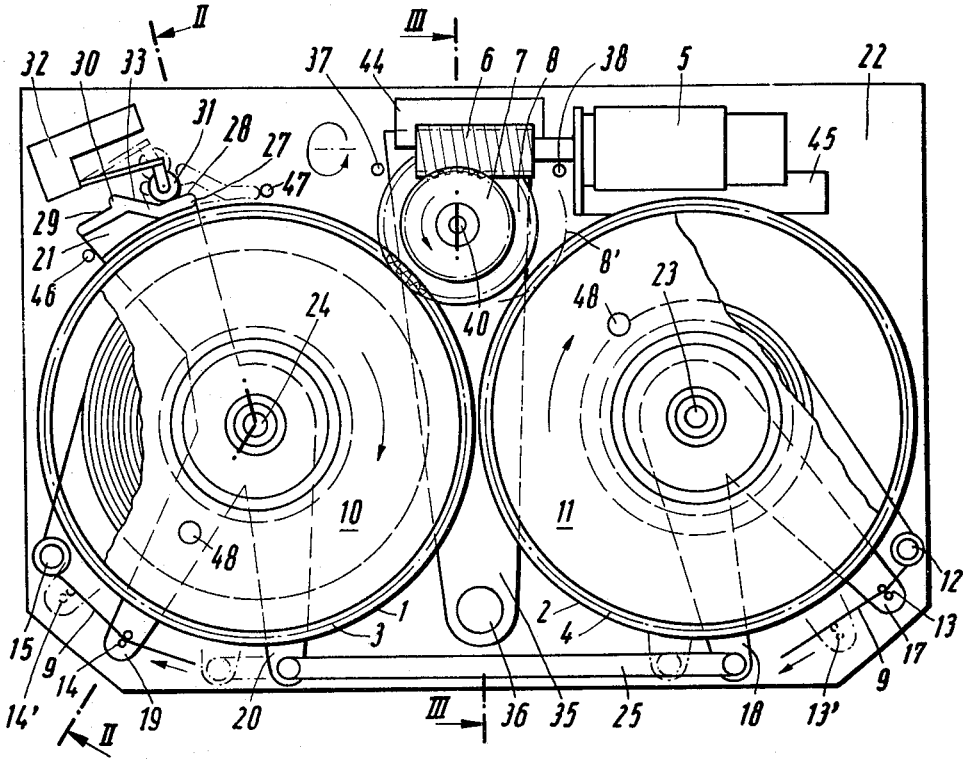
FIG. 1 is a top plan view of a ribbon feed mechanism according to the invention, taken in the direction of arrow I in FIGS. 2 and 3.
Figure 2:
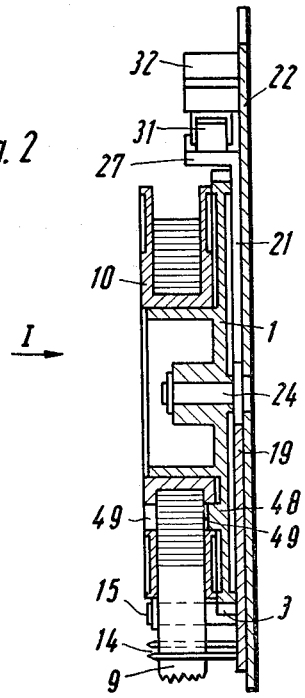
FIG. 2 is a cross section view taken substantially along the line II—II in FIG. 1.
Figure 3:
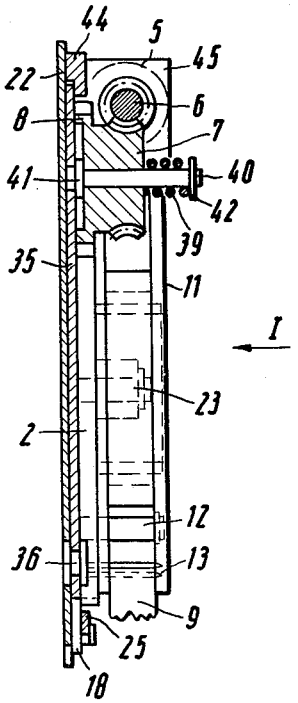
FIG. 3 is a cross section view taken substantially alone the line III—III in FIG. 1.

Referring to the drawings in greater detail, reference numberals 1 and 2 denote the two ribbon spool carriers. The latter exhibit respectively one toothed rim 3 and 4. An electric motor 5 drives a pinion 8 by way of a worm 6 and a worm wheel 7. The pinon 8, in its position shown in full lines in FIG. 1, meshes with the toothed rim 3 so that the ribbon spool carrier 1 rotates in the direction of the arrow. The inked or carbon ribbon 9, or the like, is thereby would up on the ribbon spool 10 seated on the ribbon spool carrier 1 and during this step is unwould from the ribbon spool 11 seated on the other ribbon spool carrier 2. During this operation, the ribbon 9 travels from the spool 11 via a guide roller 12 and through a ribbon guide 13 to the point where printing is effected by means of the ribbon and further through a ribbon guide 14 and a guide roller 15 to the spool 10 on the driven spool carrier 1. The extension of the ribbon between the guides 13 and 14, inessential for the invention, is not illustrated. Once the ribbon 9 has been pulled off the spool 11 except for a small remainder, the ribbon feed direction, as will be explained below, is automatically reversed by reversing the direction of rotation of the drive motor 5, whereupon the pinion 8 then meshes with the toothed rim 4 of the spool carrier 2, and the ribbon 9 is taken off the spool 10 and wound up on the spool 11 which is seated on the spool carrier 2 which is presently driven.

The ribbon guide 13 is attached to the free end of an arm 17 of a two-armed lever 17, 18; the other ribbon guide 14 is attached to the free end of an arm 19 of a three-armed lever 19, 20, 21. The lever 17, 18 is arranged between the base plate 22 and the spool carrier 2 and is pivotable about an axle trunnion 23 on which the spool carrier 2 is also rotatably mounted. In a corresponding way the lever 19, 20, 21 is pivotable about an axle trunnion 24 on which also the spool carrier 1 is rotatably supported. The lever arms 18 and 20 are articulated together by means of a push rod 25.

The free end of the lever arm 21 forms a cam carrier 27. The cam of this carrier has two sections 28 and 29. The cam section 28 extends at a smaller distance, and the cam section 29 extends at a larger distance from the toothed rim 3. Between these two sections 28 and 29 the cam carrier 27 has a dog 30. A roller 31 (or some other suitable member, e.g. a dog) travels along the cam 28, 29, 30. The bearing of the roller 31 is connected with the operating member (to be activated against a spring force) of a reversing or return switch 32 to reverse the direction of rotation of the motor 5. In the illustrated position of the switch 32 the roller 31 is on the cam section 28, the motor 5, on the shaft of which the worm 7 is seated, running in the direction of rotation entered in FIG. 1 beside the worm. Once the roller 31 is on the cam section 29, the motor 5 runs in a direction opposite to the former. An unintended activation of the switch 32, especially in case of vibrations, is avoided by the steep connecting section 33 between the cam sections 28 and 29, resulting from the differing spacings from the toothed rim 3, and the dog [lobe] 30.

The worm wheel 7 and the pinion 8 which, in the illustrated embodiment, are integrated into one member, are arranged at the free end of a lever arm 35 pivotable about a trunnion 36. The pivotability is limited by two stops 37 and 38. If the arm 35, as illustrated, contacts the stop 37, the pinion 8 meshes duly with the toothed rim 3 (i.e. the pitch line of both are in mutual contact). If the arm 35 is at the other stop 38, then the pinion 8' meshes duly with the other toothed rim 4. In the zone of the corresponding positions of the worm wheel 7 the thread of the worm 6 engages within permissible tolerances the teeth of the worm wheel 7. To facilitate this operation, the arm 35 is made to be maximally long.

For reasons explained below, the thrust exerted by the worm 6 on the worm wheel 7 and thus on the free end of the arm 35 must be so large that the arm, depending on the direction of rotation of the worm 6, is reliably pivoted, from the illustrated position wherein it contacts the stop 37, into its other, not illustrated position wherein it contacts the stop 38. The same also holds true for the opposite pivoting step. To ensure this, the pinion 8 integral with the worm wheel 7 is urged by a spring 39 against a bearing end face. The spring 39 is seated on the axle 40 for the worm wheel 7 with the pinion 8, this axle being attached to the arm 35 and having a collar 41 with this bearing end face. The bias of the spring 39 is adjusted by a nut 42 so that the thrust exerted by the worm 6 first pivots the arm 35 until the latter abuts the stop 37 or 38, whereupon the thrust of the worm 6 then rotates only the worm wheel 7 with the pinion 8 and thus the toothed rim 3 or 4, respectively, of the spool carrier 1 or 2, respectively. With the thus-adjusted bias of the spring 39 the frictional resistance during movement of the worm wheel 7 with the pinion 8 along the worm 6 is smaller than the pivot bearing friction of the worm wheel 7 with the pinion 8.

The free end of the arm 35 is guided in a guide element 44. The motor 5 is attached to an angle 45. Two stops 46 ad 47 delimit the pivotability of the arm 21 with the cam carrier 27 and thus the movability of the lever linkage 17–21 and 25.

In the illustrated position of the movable parts of the mechanism, the ribbon, as mentioned above, travels from spool 11, seated on the non-driven (thereby freely rotatable) spool carrier 2, to the spool 10 seated on the driven spool carrier 1. The spools 10, 11 are held firmly on the spool carriers 1 and 2 for rotation therewith, by the feature that a pin 48 of the spool carrier engages into a bore 49 of the spool flange. Each spool carrier exhibits a detent means (not shown) holding the spool in the axial direction. A ribbon is to be employed which exhibits close to each end a catch which cannot pass the ribbon guide 13 or 14, i.e. is wider than the guide gap. Customary catches are sheetmetal eyes in the inked ribbon.

Once the eye of the ribbon end attached to the spool 11 seated on the spool carrier 2 abuts the guide 13, it entrains this guide and thus the lever arm 17; the arm 17 is pivoted in the clockwise direction as seen in FIG. 1; the arm 18 and the push rod 25 transmit the pivoting to the lever 19, 20, 21. The lever linkage 17–21 and 25 enters the position indicated in dot-dash lines, wherein the guides are denoted by 13' and 14'. During the pivoting of the lever arm 21 the roller 31 travels from cam secion 28 onto cam section 29 whereupon the reversing switch 32 reverses the direction of revolution of the motor 5. During this step the worm 6 pushes the worm wheel 7 with the pinion 8, and thus the free end of arm 35, toward the right as seen in FIG. 1, until the arm 35 abuts the stop 38, the pinion 8' engaging the toothed rim 4 and rotating the spool carrier 2 in opposition to the direction of the arrow. In this operation the thrust exerted via the pinion 8' on the free end of arm 35 maintains the arm 35 in this position.

The ribbon is now wound up on the spool 11 seated on the spool carrier 2, from which it had been previously unwound, and is pulled off from the spool 10 seated on the spool carrier 1, onto which it had been practically completely wound previously. The ribbon feed direction is reversed.

Once the ribbon has been almost completely taken off the spool 10 seated on the spool carrier 1 and wound up on the spool 11 seated on the spool carrier 2, the eye at the ribbon end attached to the spool 10 seated on the spool carrier 1 entrains the guide 14. During this step, the ribbon feed direction is again reversed in a corresponding fashion. The movable parts of the mechanism then enter again the position shown in full lines.

If the motor is turned off, the reversing switch 32 remains in its respective position. For this reason, the motor 5, when restarted, continues running in the direction of rotation in which it operated before it was turned off. In this way it is ensured that the ribbon feed direction, even in case of any desired number of interruptions of operation of any desired length, is reversed only if the ribbon has traveled in its entirety from one spool to the other.

A torque acting on the lever linkage 17–21 and 25 in case of vibrations cannot readjust the reversing switch 32 because both positions of this switch are detents on either side of the steep cam section 33 and of the dog 30. In this connection, it is to be considered that the motor 5 is very strongly geared down by the gear 6, 7, 8 and 1 and/or 2, with respect to the radius of the ribbon which, upon operation of the reversing switch 32, is practically entirely wound up on the driven ribbon spool. As a consequence, the inclined cam section 33 and the flanks of the dog 30 can be designed to be rather steep, and the spring, the restoring force of which must be overcome for operating the switch, can be designed to be relatively rigid, resulting in secure detent positions.

If, during vibrations, acceleration forces are effective on the worm wheel 7 with pinion 8, and reset the arm 35, the latter is in each case returned, by the thrust exerted by the worm 6, into the position corresponding to the respective operating condition, namely in the same way in which it was previously moved—as described above—from its other position into this present position.

What I claim is:

1. A ribbon feed mechanism comprising, first (2,4,11) and second (1,3,10) ribbon spool carrier means rotatably connected on axes adjacent each other and adapted to feed ribbon (9) from one to the other, a reversible electrical drive motor (5) that is reversible for reversing the ribbon feed direction between said first and second ribbon spool carrier means, a reversing switch (32) having two switch positions connected to control said drive motor (5), two mutually coupled ribbon guide means (13,17,18,25 & 14,19,20) respectively, pivotally connected for movement about the respective axes of said first and second ribbon spool carrier means, first catch means on the ribbon (9) adjacent one of its ends adapted to engage one of said ribbon guide means (13) and pivotally move said two mutually coupled ribbon guide means from a first position (13,14) coordinated with the first ribbon feed direction into a second position (13',14') coordinated with the opposite ribbon feed direction, second catch means on the ribbon (9) adjacent its other end adapted to engage the other of said ribbon guide means (14) and pivotally move said two mutually coupled ribbon guide means from the second position (13',14') into the first position (13,14), operating means (21,27,31) connected with the mutually coupled ribbon guide means and connected to actuate said reversing switch (32) between its two switch positions, said operating means (21,27,31) in the first position of said ribbon guide means (13,14) connected to actuate said reversing switch (32) to its first switch position which coordinates the direction of rotation of said drive motor (5) to that which transports the ribbon (9) in the first ribbon feed direction, and said operating means (21,27,31) in the second position of said ribbon guide means (13',14') connected actuate said reversing switch (32) to its second switch position which coordinates the direction of rotation of said drive motor (5) to that which transports the ribbon (9) in the opposite ribbon feed direction.

2. A ribbon feed mechanism as defined in claim 1, in which the operating means for the reversing switch (32) includes a cam carrier (27), at least two cam sections (28,29) on said cam carrier each of which is associated with one of the two switch positions, a cam follower (31) connected to be guided by the cam sections, one of said cam carrier (27) and cam follower (31) connected to the mutually coupled ribbon guides (13,14), said reversing switch having an operating member, and the other of said cam carrier (27) and cam follower (31) connected to said operating member of the reversing switch (32).

3. A ribbon feed mechanism as defined in claim 2, a raised cam section (30) positioned between the said at least two cam sections (28,29).

4. A ribbon feed mechanism as defined in claim 2, in which said two mutually coupled ribbon guide means comprise two levers (17,18 and 19,20) each having two arm portions, a push rod (25) connected at opposite ends to one arm portion of the respective two levers, ribbon guides (13,14) attached to the second arm portion of each of the two levers, and said operating means (21,27,31) is connected for movement with the two levers (17,18 and 19,20) and said push rod (25).

5. A ribbon feed mechanism as defined in claim 4, in which one of said cam carrier (27) and cam follower (31) is connected on an arm (21) connected to one (19,20) of the two levers.

6. A ribbon feed mechanism as defined in claim 4, in which each of the two levers (17,18 and 19,20) is pivotably supported coaxially respectively with one of said first (2,4,11) and second (1,3,10) ribbon spool carrier means.

7. A ribbon feed mechanism as defined in claim 1, in which said first and second ribbon spool carrier means each include a toothed rim (3,4) a worm wheel (7) coaxially fixedly joined to a drive pinion (8), a worm (6) connected to be driven by the drive motor (5), said worm wheel (7) engaged with said worm and movable along the worm between two positions, said pinion (8) meshing in one of these two positions with the toothed rim (3) of said second ribbon spool carrier means (1) and meshing in the other (8') of the two positions with the toothed rim (4) of said first ribbon spool carrier means (2), and the frictional resistance during movement of the worm wheel (7) with the pinion (8) along the worm (6) is smaller than the pivotal bearing friction of the worm wheel with the pinion.

8. A ribbon feed mechanism as defined in claim 7, including a pivotable lever arm (35) having a free end, the worm wheel with the pinion (7,8) rotatably connected adjacent the free end of said pivotable lever arm (35), and stop means (37, 38) connected to limit the pivoted movement of said pivotable lever arm (35) in each of the two positions of the worm wheel and drive pinion (7, 8).

9. A ribbon feed mechanism as defined in claim 8, including a rotation axis and bearing end face (41) adjacent the free end of said pivotable lever arm (35), the worm wheel and drive pinion (7,8) disposed on said rotation axis, a spring (39) on said rotation axis outwardly of said worm wheel and drive pinion, and adjusting means on the rotation axis for adjusting the bias of said spring and urging the worm wheel and drive pinion against said bearing end face.

* * * * *